United States Patent [19]

Levy

[11] Patent Number: 4,660,919

[45] Date of Patent: Apr. 28, 1987

[54] LAMP SOCKET

[75] Inventor: George D. Levy, Wellesley, Mass.

[73] Assignee: Beacon Electric, Inc., Boston, Mass.

[21] Appl. No.: 785,256

[22] Filed: Oct. 7, 1985

[51] Int. Cl.[4] ..... H01R 4/24
[52] U.S. Cl. ..... 339/99 L
[58] Field of Search ..... 339/97 L, 99 L

[56] References Cited

U.S. PATENT DOCUMENTS 3,151,926 10/1964 Schick et al. ..... 339/99 L
3,594,705 7/1971 Levy ..... 339/97 L

FOREIGN PATENT DOCUMENTS 9225 9/1908 France ..... 339/97 L

*Primary Examiner*—Joseph H. McGlynn
*Attorney, Agent, or Firm*—Wolf, Greenfield & Sacks

[57] ABSTRACT

A socket assembly including a hollow socket housing into which a lamp can be inserted and a set of contacts affixed within the socket housing. The single-piece housing of a yieldable material is adapted for connection to an electric cord. The socket assembly includes a hinge member for urging against the electric cord with the hinge member having opposed outwardly extending ears that help assist in retaining the electric cord in place.

8 Claims, 5 Drawing Figures

LAMP SOCKET

BACKGROUND OF THE INVENTION

The present invention relates in general to lamp socket assemblies, and more particular, to a socket assembly for a lamp or bulb capable of connection to a two-conductor cord in a manner to provide an electrical connection between the bulb and the cord.

In one form a socket assembly may be constructed of two pieces including a lamp receiving piece and a mating cap piece. A recess is sometimes formed in the lamp-receiving piece, thereby defining a channel which is adapted to receive a two conductor wire. Projecting into the slot or recess in the lamp-receiving piece are prongs or contacts which are adapted to penetrate the insulation of the wire when the wire is located within the recess, and the cap piece is snapped into place. One drawback associated with this structure particularly as it pertains to the assembly of the socket assembly to the wires is that the process is time consuming and costly. This is particularly so when a plurality of such socket assemblies have to be attached to a two-wire conductor for use, for example, as Christmas lights or for other lighting purposes.

A two-piece socket assembly also requires two separate molding operations. Some socket assemblies are constructed so that the cap section can be inserted in two ways, only one of which is correct. This places a burden upon the assembler to recognize the correct procedure and tends to increase the cost of the end-product.

Other more recent prior art includes my earlier U.S. Pat. No. 3,594,705 on a lamp socket which includes a single-piece housing employing an integral hinge adapted to provide positive engagement for securing a two wire assembly in a channel in the lamp socket. The structure described in U.S. Pat. No. 3,594,705 represented a substantial advance in the art providing a much more simplified socket arrangement and one that enabled proved assembly thereof to the electric cord. However, In some instances, if the electric cord was twisted, there tended to be a breaking of contact between the conductor in the electric cord and the contacts associated with the socket.

Accordingly, it is an object of the present invention to provide an improvement in a single-piece lamp socket, whereby the contact between the electric cord and the socket contacts is more positive and not prone to at least periodic disconnection. This tended to cause a flickering effect at the lamp socket bulb.

A further object of the present invention is to provide a simple, integral, fool-proof, one-piece lamp socket assembly for connection to a two-wire conductor or electric cord.

SUMMARY OF THE INVENTION

To accomplish the foregoing and other objects, features and advantages of the invention, there is provided a lamp socket assembly for holding a bulb and for attachment to a pair of current-carrying wires typically referred to as an electric cord having insulation on these wires. The lamp socket assembly comprises a one-piece housing member including a hollowed part having means engageable with the base of the light bulb when the ladder is advanced into the member from one end thereof. The housing member has wall portions at the other end thereof defining a recess for receiving a section of current-carrying wires. The housing member further includes a hingeable cap portion having a wire contacting portion movable into engaging relationship with the wire in the recess, in a hinge part integrally formed with the cap portion for pivoting the cap portion and hollowed part to and away from one another along with a pair of electrical contacts. In accordance with the invention, the cap portion supported by the hinge has associated therewith oppositely and outwardly directed ears that are adapted to engage the current carrying wires for providing additional outwardly directed support to maintain the current carrying wires in a position of an enhanced securement in the channel thus preventing intermittent disconnection at the contacts.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
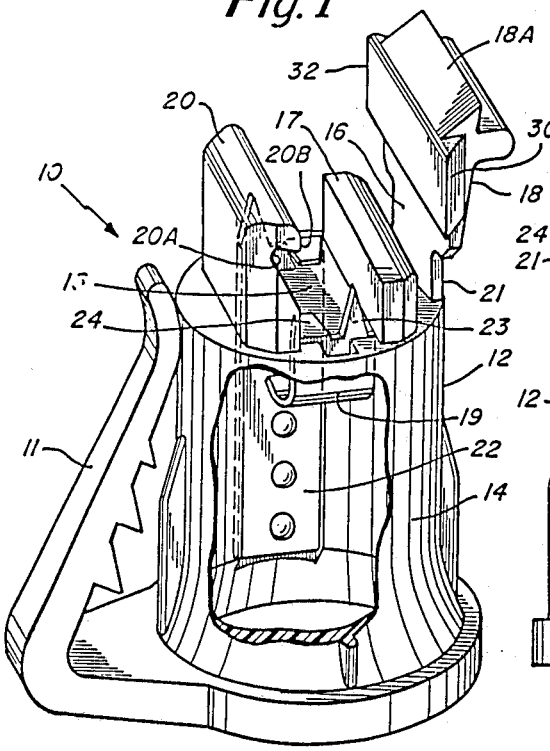
FIG. 1 is a perspective view of a lamp socket assembly in accordance with the present invention, partially sectioned away.
Figure 2:
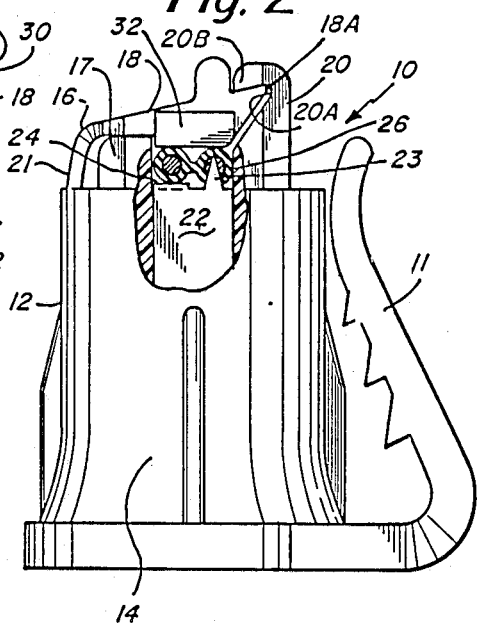
FIG. 2 is a side elevation view of the lamp socket of FIG. 1 showing the hinging part in its closed position compressing the electric cord.
Figure 3:
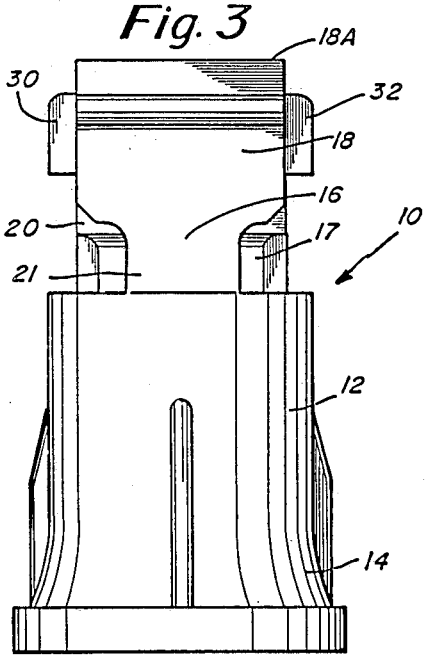
FIG. 3 is also a side elevation view of the lamp socket of FIGS. 1 and 2 taken at a position directed toward the open hinge part of the socket.
Figure 4:
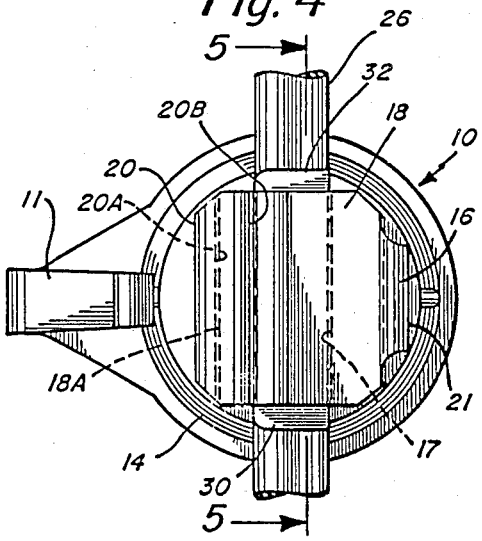
FIG. 4 is a top view of the socket of FIGS. 1–3 with the hinge in its closed position and illustrating the manner in which the oppositely disposed side ears extend to contact and support the electric wires.
Figure 5:
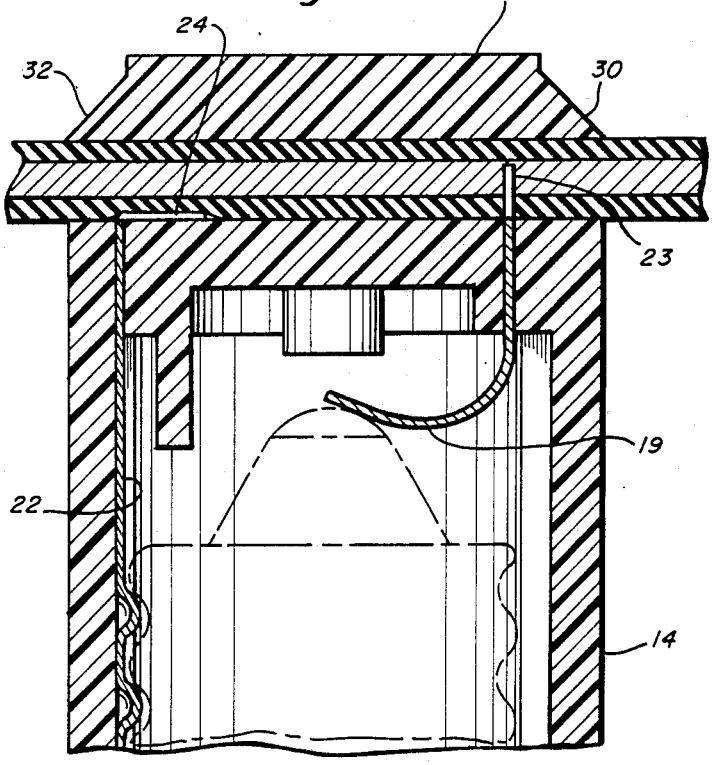
FIG. 5 is a fragmentary cross-sectional view taken along line 5—5 of FIG. 4.

Lamp socket assembly 10 is shown in FIGS. 1–5. FIG. 1 illustrates it in a perspective view, FIG. 2 illustrates it in an opposite side elevation view, FIG. 3 illustrates it in a second side elevation view toward the hinge and FIG. 4 illustrates it in a top view. The lamp socket assembly 10 generally comprises a one-piece socket housing 12 having a lamp receiving part 14 and a cap portion 18. The socket assembly 10 also includes a set of contacts 19 and 22 held within socket assembly 12, as shown in FIGS. 1 and 2. FIG. 1 also shows the clip 11 which is integrally formed as part of socket housing 12. The clip 11 is adapted to facilitate connection of the socket assembly to an article such as a nail or tree branch.

The lamp receiving part 14 is formed with projecting wall portions 20, 21. Wall portion 20 has a recess 20A formed in one face. Cap portion 18 has a face with a projecting flange 18A shaped to mate with the recess 20A and wall portion 20. Hinging portion 16 is integrally formed between cap portion 18 and wall portion 21. The hinge portion 16 is constructed of a relatively thin plastic material so as to provide proper flexibility in hinging action.

Inside of the hinge portion 16, when the hinge is closed, a portion thereof is adapted to fit against the abutting wall 17. The wall 17 also provides a part of the channel that receives the electric cord.

In FIG. 1 the socket is shown with its hinge in its open position. In FIG. 2 the hinge is shown in its closed position, in which case the mating faces are fixedly interlocked as indicated. In this connection, it is also noted that the recess 20A is formed at least in part by the ridge 20B. This ridge is useful in assisting in the closing of the hinge part and at the same time forms one side of the interlocking recess.

In FIG. 1 there are no electrical cords or wires shown so that there is illustrated piercing tab 23 and positioning tab 24 of one of the contacts as positioned in the socket housing 12. Both of the contacts are inserted into a slip provided during the molding operation. The contacts are inserted in the slot. The contact 19 has a turned bottom adapted for contact with the bottom of the bulb, while the contact 22 is dispased on the side of the hollow bulb receiving portion of the housing. When a two-conductor wire is placed in the recess 15 and cap lock 18 is forced down into an interlock position, one of the wires is pierced by piercing tab 23 and an electrical contact is formed between the pierced wire and the associated contact. A second contact positioned on the other side provides contact for the second wire. The piercing parts of each contact are offset so that one contacts one wire of the two-wire conductor while the other one contacts the other wire. With regard to the channel 15, it is noted that this is provided between the wall portion 20 and the wall 17.

The drawing also illustrate the lamp socket assembly as having a hollow socket for receiving the bulb. The bulb may be threaded into the socket and in this regard, threading may be carried out by means of dimples provided on the contact 22, as illustrated. Of course, other means may be provided for securing the bulb in the lamp socket.

In accordance with the invention, there is associated with the cap portion 18, a pair of oppositely disposed ears, 30 and 32. As illustrated in the drawings, these ears extend outwardly from the body of the cap portion on either side and when the cap portion is in its interlocked position, these outwardly extending ears extend along and in the direction of the conductor wires 26. It is noted that these outwardly disposed ears extend beyond the contacts so as to provide support outside of the contacts, so that even if the current carrying wires should be twisted outside of the socket, there is a securing action by virtue of the ears to maintain proper contact between the contacts and the conductor wires. It is noted that the outer extent of the ears correspond substantially with the outer diameter of the housing 12. It is also noted that on the housing 12, outside of the contacts, there is provided a support surface also for the electrical current carrying wire. Thus, there is actually a gripping action by virtue of the interaction between the ears and the housing top ledge. The conductor wires once in place essentially provide a securing means outside of the place where the contacts pierce the wires. In accordance with the invention the hinge interlock is of the improved type in which the interlocking recess is of wedge shape to correspond with the wedged interlocking tab on the hinge part. This provides for a positive form of interlocking in the interlocked position of the socket.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A lamp socket assembly for holding a bulb and for attachment to a pair of current-carrying wires having insulation thereon comprising a one-piece housing member including a hollowed part having means engageable with the base of said light bulb when the latter is advanced into the member from one end thereof, said housing member having wall portions at the other end thereof defining a recess for receiving a section of current carrying wires, said member further including a cap portion having a wire contacting portion moveable into engaging relationship with wire in said recess and a hinge part integrally formed with said cap portion and hollowed part for pivoting said cap portion and hollowed part to and away from one another and a pair of electrical contacts, each held within the member and protruding into the recess defined by the wall portions thereof, each contact having ends thereon adapted for piercing the insulation of a respective current-carrying wire and for making electrical contact with the conductor portion of the wire, said contacts also having means thereon adapted for making electrical contact with respective conductor portions of the light bulb, one of the wall portions and the cap portion each having complementary mateable faces that are adapted to interlock when in a closed position causing said wire contacting portion to extend into said recess forcing said wires against said contacts piercing the insulation of said wires and thereby causing an electrical contact from the wires to the bulb, said wire contacting portion including a flat member for engagement with the wires including oppositely disposed ears extending in the direction of said wires and extending outwardly of said cap portion, said ears being disposed outside of said contacts to provide secure holding of the wires adjacent the contacts, said housing member hollowed part defined at least in part by a cylindrical wall having a substantially flat end wall against which the wires rest and a substantially circular outer edge, said ears being integral with the wire contacting flat portion of the flat member and each having a wire contacting surface that is contiguous with the contacting surface of the flat portion of the flat member, each ear having its inner side disposed substantially overlying the inner diameter of the cylindrical wall and its outer side disposed substantially overlying the outer diameter of the cylindrical wall at said circular outer edge.

2. A lamp socket assembly as defined in claim 1 wherein the hollowed part of the housing member internally includes means for threadedly accommodating the bulb.

3. A lamp socket assembly as defined in claim 1 wherein the hollowed part of the housing member internally includes space nipple-like protruberances capable of accommodating the bulb.

4. A lamp socket assembly as defined in claim 1 wherein said ears each have a tapered shape extending to an outer terminating end line.

5. A lamp socket assembly as defined in claim 1 wherein each contact includes a bent positioning tab which is adapted to control the positioning of the contact within the housing.

6. A lamp socket assembly as defined in claim 5 wherein the positioning tab is bent at a right angle to the remainder of the contact.

7. A lamp socket assembly for holding a bulb and for attachment to a two-conductor current-carrying wire having insulation thereon comprising;

a unitary housing member including;

a. a lamp-receiving part, cylindrical in shape and having an outer surface and an inner surface having means engageable with the light bulb when the latter is advanced into the lamp-receiving part from one end thereof, b. first and second wall portions projecting from the lamp-receiving part, and defining a recess for accommodating the current carrying wires, c. a cap portion including a wire contacting boss positionable within said recess and against said wires when said cap portion is locked to said lamp-receiving part, the first wall portion and the cap portion having complementary mating faces, and d. a hinging portion intermediate between the second wall portion and the cap portion, and a pair of contacts each held within the member and protruding into the recess defined by the wall portions thereof, each contact having an end thereon adapted for piercing the insulation of a respective current-carrying wire and for making electrical contact with the conductor portion of the wire, said contacts also having means thereon adapted for making electrical contact with respective conductor portion of the light bulb, the confronting complementary mating faces of the first wall portion, and the cap portion being adapted for movement about the hinging portion and to interlock when in a closed position whereby the boss is forced into said recess against said wires thereby causing the piercing of the wire by the contact and further causing an electrical contact between the conductor wires and the inserted bulb, said wire contacting portion including a flat member for engagement with the wires including oppositely disposed ears extending in the direction of said wires and extending outwardly of said cap portion, said ears bing oppositely disposed ears extending in the direction of said wires and extending outwardly of said cap portion, said ears being disposed outside of said contacts to provide secure holding of the wires adjacent the contacts, said housing member hollowed part defined at least in part by a cylindrical wall having a substantially flat end wall against which the wires rest and a substantially circular outer edge, said ears being integral with the wire contacting flat portion of the flat member and each having a wire contacting surface that is contiguous with the contacting surface of the flat portion of the flat member, each ear having its inner side disposed substantially overlying the inner diameter of the cylindrical wall and its outer side disposed substantially overlying the outer diameter of the cylindrical wall at said circular outer edge.

8. A lamp socket assembly as defined in claim 7 wherein said ears each have a tapered shape extending to an outer terminating end line.

* * * * *